US008561542B2

(12) United States Patent
Authement, Sr.

(10) Patent No.: US 8,561,542 B2
(45) Date of Patent: Oct. 22, 2013

(54) SHOTGUN SHELLS HAVING COLORED PROJECTILES AND METHOD OF USING SAME

(76) Inventor: Joseph Authement, Sr., Lafayette, LA (US)

( * ) Notice: Subject to any disclaimer, the term of this patent is extended or adjusted under 35 U.S.C. 154(b) by 0 days.

(21) Appl. No.: 12/514,255

(22) PCT Filed: Jul. 9, 2008

(86) PCT No.: PCT/US2008/069556

§ 371 (c)(1),
(2), (4) Date: May 8, 2009

(87) PCT Pub. No.: WO2009/025938

PCT Pub. Date: Feb. 26, 2009

(65) Prior Publication Data

US 2010/0037794 A1 Feb. 18, 2010

Related U.S. Application Data

(60) Provisional application No. 60/948,675, filed on Jul. 9, 2007.

(51) Int. Cl.
*F42B 7/04* (2006.01)
*F42B 12/40* (2006.01)

(52) U.S. Cl.
USPC ..... 102/459; 102/513

(58) Field of Classification Search
USPC ..... 102/448, 458, 459, 513
See application file for complete search history.

(56) References Cited

U.S. PATENT DOCUMENTS

| | | | | | |
|---|---|---|---|---|---|
| 1,304,962 | A * | 5/1919 | Gravely | 102/458 |
| 2,408,155 | A * | 9/1946 | Thornbury | 148/248 |
| 2,772,634 | A * | 12/1956 | Oberfell | 102/459 |
| 2,919,647 | A * | 1/1960 | Dear et al. | 102/459 |
| 3,146,713 | A * | 9/1964 | Sawyer | 102/448 |
| 3,363,561 | A * | 1/1968 | Irons | 102/459 |
| 3,877,381 | A * | 4/1975 | McCoy | 102/501 |
| 4,080,899 | A * | 3/1978 | Luban | 102/458 |
| 4,389,939 | A * | 6/1983 | Ofuji | 102/458 |
| 4,714,023 | A * | 12/1987 | Brown | 102/516 |
| 5,264,022 | A * | 11/1993 | Haygarth et al. | 75/255 |
| 5,528,988 | A * | 6/1996 | Lindgren et al. | 102/459 |
| 5,773,752 | A * | 6/1998 | Blume et al. | 102/513 |
| 6,173,652 | B1 * | 1/2001 | Taylor | 102/459 |
| 6,209,180 | B1 * | 4/2001 | Amick | 86/57 |
| 6,576,598 | B2 * | 6/2003 | Brown | 508/118 |
| 6,931,993 | B1 * | 8/2005 | Manole et al. | 102/458 |
| 2003/0078170 | A1 * | 4/2003 | Brown | 508/115 |

* cited by examiner

*Primary Examiner* — Bret Hayes

(57) ABSTRACT

The invention includes a number of shotgun shells having colored projectiles. When each shooter in a party of shooters utilize shotgun shells which have a projectiles of a color which is uniquely distinctive to that shooter then one is able to determine, by post-shooting inspection of an animate or inanimate target which was fired at by multiple shooters of said party, which of said shooters actually struck the target, how many times and at what place on said target The invention is therefore useful in accurately crediting each shooter for the accuracy of their shooting.

9 Claims, 1 Drawing Sheet

SHOTGUN SHELLS HAVING COLORED PROJECTILES AND METHOD OF USING SAME

CROSS REFERENCE TO RELATED APPLICATIONS

This application claims priority to U.S. Provisional Patent Application No. 60/948,675 filed Jul. 9, 2007.

BACKGROUND OF THE INVENTION

1. Field of Invention

The invention relates generally to the art of firearms, more specifically to the field of shotguns, with more specificity to ammunition for shotguns, namely to shells for shotguns ("shotgun shells").

2. General Background

Fire arms, shotguns and shells (a pre-loaded, ready-to-fire head and case complete with primer, powder charge, wad and at least one, but commonly a number of, metal projectiles) for shotguns is relatively old art. Over the years improvements have been made to each of the above mentioned components and considerable effort has been devoted to making "tracer" shotgun shells (illuminated means to follow the path of the projectiles).

An issue is sometimes presented when multiple shooters of shotguns fire at the same target, such as is frequently the case when there are multiple parties attempting to down flying birds. In this situation dispute can arise as to which of the shooters downed which of the birds and therefore owns them. Due to regulations limiting the type and number of birds taken by each shooter the issue presented can sometimes have civil or even criminal implications. It does not appear that this issue has been addressed by prior art.

OBJECTS OF THE INVENTION

The principal object of the invention herein disclosed and claimed is to provide a means by which one is able to determine, from post-shooting inspection of an animate or inanimate target which has been fired at by multiple shooters, which of said multiple shooters actually struck the target, and if desired how many times each of said multiple shooters struck the target, whereupon the target each of the shooter's projectiles struck and other information relevant to the accuracy and efficacy of each shooter's firing at the target, so that disagreement concerning same may be prevented, resolved or at least mitigated. A secondary object of the invention is to make projectiles lodged in an animate target intended for consumption more visible, thus easier to remove prior to consumption, so as to mitigate against the possibility of consumption (or teeth damage from biting into a metal projectile).

SUMMARY OF THE INVENTION

The invention herein disclosed and claimed accomplishes the above stated objects by providing a number of shotgun shells having colored projectiles and use thereof. By each shooter utilizing shells having projectiles of a color which is uniquely distinctive to that shooter one is able to determine from post-shooting inspection of an animate or inanimate target whether that shooter actually struck the target, if so with how many projectiles, where on the target that shooter's projectiles actually struck and possibly other information relevant to the accuracy and efficacy of that shooter's firing at the target. In addition thereto by providing projectiles having a color which is distinctively different than the flesh of animate targets the projectiles in the target are more visible, easier to remove prior to consumption of the flesh.

BRIEF DESCRIPTION OF THE DRAWINGS

For further understanding of the nature and objects of the present invention, reference should be made to following description of the preferred embodiment of the invention taken in conjunction with the accompanying drawings, in which like parts are given like reference numerals, and wherein.

DESCRIPTION OF THE PREFERRED EMBODIMENT OF THE INVENTION

While the present invention will be described with reference to preferred embodiments, it will be understood by those who are skilled in the art that various changes may be made and equivalents may be substituted for elements thereof without departing from the scope of the invention. In addition, many modifications may be made to adapt a particular situation or material to the teachings of the invention without departing from the essential scope thereof. It is therefore intended that the present invention not be limited to the particular embodiments disclosed as the best mode contemplated for carrying out this invention, but that the invention will include all embodiments and legal equivalents thereof.

In the field of hunting, particularly when a hunting party comprises multiple shooters, and particularly when attempting to shoot flying birds, disagreements can and do arise as to which of the shooters actually shot which of the recovered animal or animals. The invention herein disclosed provides a solution to the above described problem, namely each of the shooters in a hunting party is to use shells having projectiles which have a distinctively different visual appearance from the projectiles contained in the shells of other hunters (or teams of hunters) of the hunting party (or other nearby shooters). Accordingly if multi-shooters should fire towards an animal or group of animals and question should arise as to which of the hunters actually shot the recovered animal or animals, examination of the projectiles in the downed animal will typically be able to resolve the question of which of the shooters actually hit the animal. On some occasions examination of the projectile or projectiles found in the recovered animal may reveal only one hunter actually hit the animal. On other occasions examination of the projectile or projectiles found in the recovered animal may indicate that multiple hunters may fairly be credited with having shot the animal.

Figure 1:
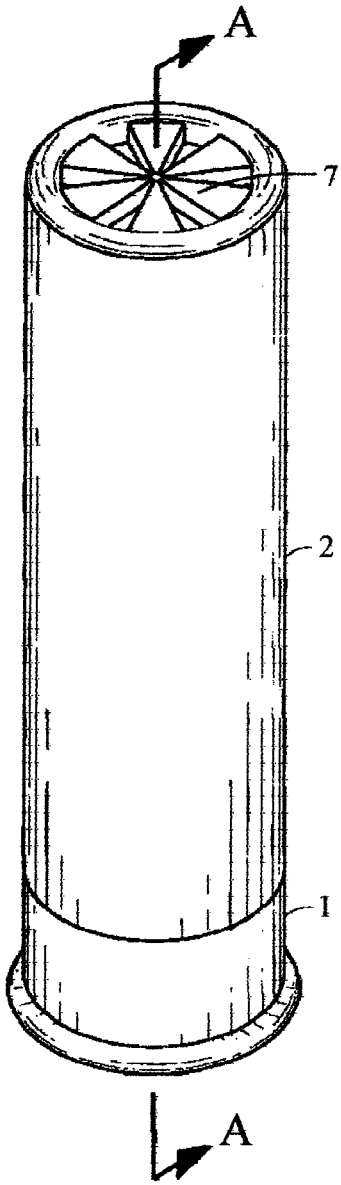
FIG. 1 is an isometric view of the exterior of a shotgun shell of the present invention.
Figure 2:
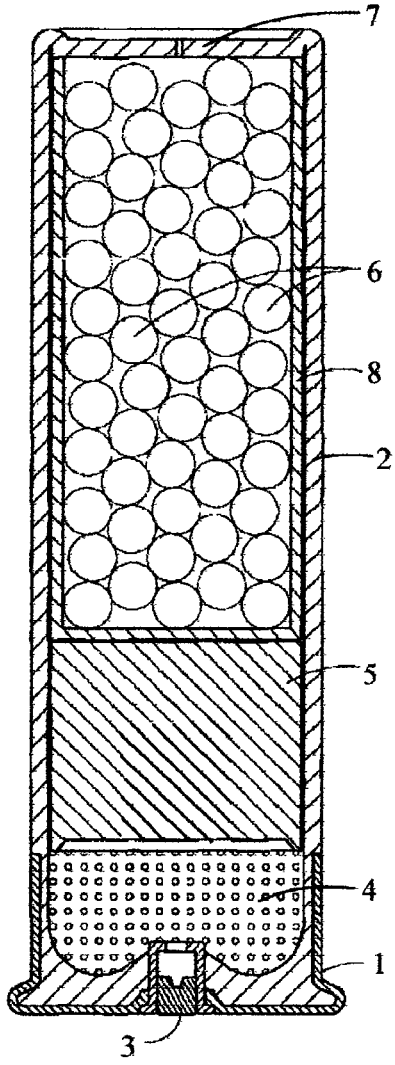
FIG. 2 is a cross sectional view of the shotgun shell along A-A of FIG. 1.

Referring both to FIGS. 1 and 2 a shotgun shell of the present invention is seen, from the exterior in FIG. 1 and in cross-section along plane A-A of FIG. 1 in FIG. 2. In general a shotgun shell of the present invention will have the following components, head 1, case 2, primer 3, powder charge 4, wad 5, projectiles 6, closed end 7 and optionally liner 8.

In preferred the preferred embodiment of the invention the exterior surface of projectile or projectiles 6 is of a color that is visually distinctive from the natural color of the metal from which the projectiles 6 are made and is also of a color which visually distinctive from the color of the exterior surface of the projectiles 6 of the shotgun gun shells of other shooters within range of an animate or inanimate target that is likely to be targeted by multiple shooters. Accordingly in preferred embodiment the invention herein disclosed is comprised of a set of shotgun shells. Each of set of shells contains a plurality of individual shells (or sub-set of multiple shells) each of which individual shells (or subset of shells) contains projectiles 6 which are visually distinctive from projectiles 6 of each of said individual shells (or sub-set of shells) in said set of shells. In order to distinguish between different shooters (or as may be desired, team of shooters) each of said shooters (or team of shooters) is assigned (or chooses) an individual shell (or sub-set of shells) which contain projectiles 6 (sometimes called "shot", "pellets", "BBs" or "slugs") which are visually distinctive from other shooters (or team of shooters) of the hunting party (or other nearby shooters). In this way the color of projectiles 6 found during post-shooting inspection of a target, whether an animate or inanimate target, which has been fired at by multiple shooters is can reveal which of said multiple shooters actually struck the target, how many times, where on the target each shooter's projectile(s) 6 actually struck and other information relevant to the accuracy and efficacy of each shooter's efforts to strike the target.

In preferred embodiment of the invention projectiles 6 are made visually distinctive from other projectiles 6 by means of coloring the surface of projectiles 6. In the simplest form the projectile (or sub-set of projectiles) 6 are coated with a paint, dye or ink which adheres well to the material from which the projectiles 6 are made, which is typically lead, steel or copper, but may be other metals, compounds thereof or sometimes even non-metals. By providing each shooter shotgun shells in which the projectiles 6 have a color or group of colors which is unique to that shooter, the accuracy and efficacy of each shooters at striking a target, whether animate or inanimate, can be determined by post-shooting inspection of the target (determining the color of the projectiles 6 lodged therein). A secondary benefit to using shotgun shells having colored projectiles 6 is by utilizing high colors which are highly distinctive from the color of the part of the target that the projectiles 6 are likely to lodge in (for instance, distinctive from the flesh of an animal) the projectiles 6 are more visible, thus easier to locate and if desired to remove from the target, which facilitates not only determination of accuracy of a shooter's efforts, but mitigates against accidental consumption of projectiles 6, or damage to teeth from accidentally biting into a projectile 6.

Whatever means is used to color the surface of projectiles 6 it should, of course, be sufficiently durable to remain visible after being fired from a gun and striking an animate or inanimate target. In practice this is not difficult. Many baked-on, even air-dried or catalytically cured dyes, paints and inks are sufficiently durable for one-time use, particularly when applied to projectiles 6 which have been prepared to receive them, such as by removing oil, grease or other residue that might interfere with good adhesion and/or etching the surface, for instance with an acid, prior to application of the dye, paint, ink or other coloring system.

In choosing a dye, paint, ink or other coloring system consideration must be given to toxicity (if any) to wounded animals, if accidentally eaten by other animals and/or potential environmental harm that may be result from use of a chosen paint or dye. Those skilled in the art will recognize that paint or dye is not the only means by which projectiles might be made which are of different color.

In preferred embodiment of the invention the head 1, case 2 or closed end 7 will be marked or formed in a manner which identifies the color of the projectiles 6 containing in that shell. The preferred way of doing this is by making utilizing a transparent or translucent "plastic" (polymer) for case 2. Alternatively case 2 might be made of a material which is approximately the same color as projectile(s) 6 contained therein. Alternatively closed end 7 might be closed with a disc of even color. Alternatively head 1, case 2 or closed end 7 may be marked with color, text or symbol that identifies the color of projectiles 6 contained in that shell.

Those skilled in the art will recognize that color is not necessarily the only way projectiles 6 emanating from one shooter gun (or one teams of shooters' guns) might be made visually distinctive from projectiles 6 of a different shooter. Distinctiveness might also be achieved by texture or pattern of different projectile 6 surfaces. For instance one set of shells might have a smoothly polished surface, one set of shells have an unpolished surface. Other sets of shells might have concave dimples, another convex dimples. Various other surface indentations, elevations, engravings, numbering, coloring, coating, plating, striping and other means known to those skilled in the art to distinguish one surface from another might be used to form a set of shells which have individual shells (or sub-set of shells) which are visually distinct from other individual shells (or sub-set of shells) in said set of shells.

The invention is simple and easy to use. For instance, if a hunting party consists of three shooters then the invention may consist a set of shells containing at least three shells (or sub-set of shells) having projectiles 6 of different (for example) color (for instance) red, white and blue. One shooter might be assigned or chose, for instance, shells having red projectiles 6, another shooter might be assigned or chose, for instance, shells having white projectiles 6, and the last shooter, for instance, be assigned or chose, for instance, shells having blue projectiles 6. If in this instance more than one of the shooters were to fire at a target one would be able to determine, by post-shooting inspection of the target for the color of projectiles 6 found therein, able to determine which of the shooters actually struck the target, if so how many of each shooter's projectiles 6 actually struck the target, exactly where on the target those projectile(s) 6 actually struck and other information relevant to the accuracy and efficacy of each shooter's efforts to strike the target.

Those skilled in the art will realize that each shooter might not be assigned or choose shells having projectiles 6 of only one color, but be assigned or chose shells each of which has projectiles 6 of different (but nevertheless uniform within each shell) color (or appearance). For instance, in a three hunter group, one shooter may be assigned or chose shells having red projectiles 6 and shells having white projectiles 6, another assigned or chose shells having green and chose shells having yellow projectiles 6, another might chose shells having blue and shells having purple projectiles 6. So long as no two shooters (or team of shooters) uses shells having projectiles 6 which are of same color (or other appearance) to other shooters (or team of shooters) one will be able to determine, by examination of projectile(s) 6 found in a recovered animal (or non-living target) which of the shooters (or team of shooters) actually struck the animal or target.

Similarly those skilled in the art will realize that while same may not be necessary except for purposes of novelty, individual shells need not have uniformly colored (or appearing) projectiles 6 therein. For instance a shell, or a set of shells, might employ projectiles 6 of red, white and blue color. That shell, or set of shells, would nevertheless be uniquely distinctive from another shell, or set of shells, employing, for instance green, yellow and orange projectiles 6, thereby the set of shells would still serve at least some objects of the invention, namely to identify accuracy and efficacy of two (in this instance) shooters or groups of shooters at striking a target, whether animate or inanimate, that multiple shooters fire at.

So long as no two shooters (or two groups of associated shooters) use shells containing projectile(s) 6 of a color that are indistinguishable from each other then identification of a shooter may be made from examination of projectile(s) 6 found in a target both shooters (or associated group of shooters) has fired at.

While the above description contains certain specifics, these should not be construed as limitations on the scope of the invention, but rather as an exemplification of one preferred embodiment thereof. Accordingly, the scope of the present invention should be determined not by the embodiment(s) illustrated, but by such claims and their legal equivalents as may be granted upon the disclosure herein made.

What is claimed is:

1. A first shot-gun shell for hunting a game animal which has an edible flesh of a known color, for determining whether a shooter, who discharged said shot-gun shell at a taken animal, actually struck the animal, and to facilitate locating projectiles from the shot-gun shell which are lodged in said flesh of said animal and thereby facilitate removal of said projectiles from said flesh prior to consumption, comprising:

a head;

a case;

a primer;

a powder charge;

a plurality of metal projectiles having an etched outer surface and having a coating adhesively attached to said etched outer surface, wherein said coating is heat resistant; is sufficiently durable to remain visible after the projectiles have been discharged from a shot-gun, strike and embed in the flesh of said animal; is non-toxic to an animal who may be wounded with metal projectiles having said coating; is non-toxic to an animal who may eat metal projectiles having said coating; is non-harmful to the environment and has a color which is selected from the group of colors consisting of red, blue, green, yellow, orange and purple and is chosen from said group of colors so as to be a color, which is different from the color of the flesh of the animal at which said shot-gun shell is to be discharged and also different from a color of projectiles of a second shot-gun shell, which is also different from the color of the flesh of the game animal to be fired at by another shooter; and, a closed end.

2. The shot-gun shell of claim 1 wherein said outer surface of said metal projectiles is etched by acid prior to adhesion of said coating thereto.

3. The shot-gun shell of claim 2 wherein oil, grease or other substances that may prevent good adhesion of said coating to the outer surface of said metal projectiles is removed prior to adhesion of said coating thereto.

4. A set of shot-gun shells, having closed ends, for shooting game animals having an edible flesh of a known color, for use by a party having a plurality of shooters, for determining, which of the shooters who discharged at least one shot-gun shell from said set of shot-gun shells at a taken animal, actually struck the animal, and to facilitate locating projectiles from said set of shot-guns shells in said flesh of said animal and thereby facilitate removal of said projectiles from said flesh prior to consumption, comprising:

a. a first sub-set of shot-gun shells having at least one member shell, wherein each of the shot-gun shells of said first sub-set of shot-gun shells has a plurality of metal projectiles having an etched outer surface and having a coating adhesively attached to said etched outer surface, wherein said coating is heat resistant; is sufficiently durable to remain visible after the projectiles have been discharged from a shot-gun, strike and embed in the flesh of said animal; is non-toxic to an animal who may be wounded with metal projectiles having said coating; is non-toxic to an animal who may eat metal projectiles having said coating; is non-harmful to the environment and has a first color, wherein said first color is selected from the group of colors consisting of red, blue, green, yellow, orange and purple and is chosen from said group of colors so as to be a color which different from the color of the flesh of the animal at which said first sub-set of shot-gun shells are to be discharged; and, b. a second sub-set of shot-gun shells having at least one member shell, wherein each of the shot-gun shells of said second sub-set of shot-gun shells has closed end and a plurality of metal projectiles having an etched outer surface and having a coating adhesively attached to said etched outer surface, wherein said coating is heat resistant; is sufficiently durable to remain visible after the projectiles have been discharged from a shot-gun, strike and embed in the flesh of said animal; is non-toxic to an animal who may be wounded with metal projectiles having said coating; is non-toxic to an animal who may eat metal projectiles having said coating; is non-harmful to the environment and has a second color, wherein said second color is selected from the group of colors consisting of red, blue, green, yellow, orange and purple and is chosen from said group of colors so as to be a color which different from the color of the flesh of the animal at which said second set of shot-gun shells are to be discharged and also chosen so as to be different from said first color of the coating of said projectiles of said first sub-set of shot-gun shells.

5. The set of shot-gun shell of claim 4 wherein said outer surface of said metal projectiles of said set of shot-gun shells is etched by acid prior to adhesion of said coating thereto.

6. The set of shot-gun shells of claim 5 wherein oil, grease or other substances that may prevent good adhesion of said coating to the outer surface of said metal projectiles is removed prior to adhesion of said coating thereto.

7. A method for hunting game animals which have an edible flesh of a known color by a party of hunters, for determining whether shooters, who discharged at least one shot-gun shell at a taken animal, actually struck the animal, and to facilitate locating shot-gun projectiles lodged in said flesh of said animal and thereby facilitate removal of said projectiles from said flesh prior to consumption, comprising:

a. forming a party containing a plurality of hunters;

b. assigning a first hunter of said plurality of hunters with a set of shot-gun shells each of which has a closed end and having a plurality of metal projectiles having an etched outer surface and having a coating adhesively attached to said etched outer surface, wherein said coating is heat resistant; is sufficiently durable to remain visible after the projectiles have been discharged from a shot-gun, strike and embed in the flesh of said animal; is non-toxic to an animal who may be wounded with metal projectiles having said coating; is non-toxic to an animal who may eat metal projectiles having said coating; is non-harmful to the environment and has a first color, wherein said first color is selected from the group of colors consisting of red, blue, green, yellow, orange and purple and is chosen from said group of colors so as to be a color which is different from the color of the flesh of the animal at which said shot-gun shell is to be discharged;

c. assigning each of the other hunters of said plurality of hunters with a set of shot-gun shells having a plurality of metal projectiles having an etched outer surface and having a coating adhesively attached to said etched outer surface wherein said coating is heat resistant; is sufficiently durable to remain visible after the projectiles have been discharged from a shot-gun, strike and embed in the flesh of said animal; is non-toxic to an animal who may be wounded with metal projectiles having said coating; is non-toxic to an animal who may eat metal projectiles having said coating; is non-harmful to the environment and has a first color, wherein said first color is selected from the group of colors consisting of red, blue, green, yellow, orange and purple and is chosen from said group of colors so as to be a color which is different from the color of the flesh of the animal at which said shot-gun shell is to be discharged, and is different than said first color and is also different that said color of said coating of said projectiles of the set of shot-gun shells assigned to any other hunter in said plurality of hunters; and, d. when a game animal is taken, examining the flesh of said animal to locate the projectiles therein, visually observing the color of the projectiles found in the flesh of the game animal to determine which of said hunters actually struck the target and removing the projectiles from the flesh of the game animal prior to consumption thereof.

8. The method of claim 7 wherein the outer surface of said metal projectiles of said set of shot-gun shells is etched by acid prior to adhesion of said coating thereto.

9. The method of claim 8 wherein oil, grease or other substances that may prevent good adhesion of said coating to the outer surface of said metal projectiles is removed prior to adhesion of said coating thereto.

* * * * *